US005441396A

United States Patent [19]

Nicetto

[11] Patent Number: 5,441,396

[45] Date of Patent: Aug. 15, 1995

[54] MACHINE FOR THE CENTRIFUGAL MOLDING OF LOW-MELTING METALS OR SYNTHETIC MATERIALS

[75] Inventor: Romeo Nicetto, Senago, Italy

[73] Assignee: NICEM S.p.A., Senago, Italy

[21] Appl. No.: 133,417

[22] Filed: Oct. 8, 1993

[30] Foreign Application Priority Data

Oct. 14, 1992 [IT] Italy ..... MI92U0892

[51] Int. Cl.[6] ..... B29C 41/04; B22D 13/12

[52] U.S. Cl. ..... 425/73; 164/153; 164/286; 425/152; 425/425

[58] Field of Search ..... 425/73, 74, 75, 34.3, 425/135, 151, 152, 153, 169, 210, 425; 164/154, 153, 259, 286, 412

[56] References Cited

U.S. PATENT DOCUMENTS

| | | | |
|---|---|---|---|
| 1,633,591 | 6/1927 | Lamplough | 425/73 |
| 3,016,573 | 1/1962 | Blue | 425/73 |
| 4,292,015 | 9/1981 | Hritz | 425/73 |
| 4,350,481 | 9/1982 | Corea et al. | 425/73 |
| 4,943,221 | 7/1990 | Friesen | 425/73 |
| 5,223,278 | 6/1993 | Nicetto | 425/425 |

FOREIGN PATENT DOCUMENTS

| | | | |
|---|---|---|---|
| 1133314 | 1/1985 | U.S.S.R. | 425/73 |

*Primary Examiner*—James P. Mackey

*Attorney, Agent, or Firm*—Guido Modiano; Albert Josif

[57] ABSTRACT

The machine has a main structure which supports, so that they can rotate about a substantially vertical rotation axis, a lower plate for supporting a centrifugal molding die and an upper plate. The plates face each other on a substantially horizontal plane and are mutually movable in a direction parallel to the rotation axis in order to ensure closure of the mold or to allow removal of the mold. The plates are accommodated in a chamber which is delimited by walls connected to the main structure and has, on the front side of the machine, an opening for access to the die. The opening is closed by a movable cover connected to at least one of the side walls delimiting the chamber by a pair of connecting rods. Each connecting rod has one end pivoted to the cover and another end pivoted to the related side wall with substantially horizontal pivoting axes to allow an opening movement of the cover along a vertical upward component and along a horizontal component toward the rear side of the machine.

18 Claims, 2 Drawing Sheets

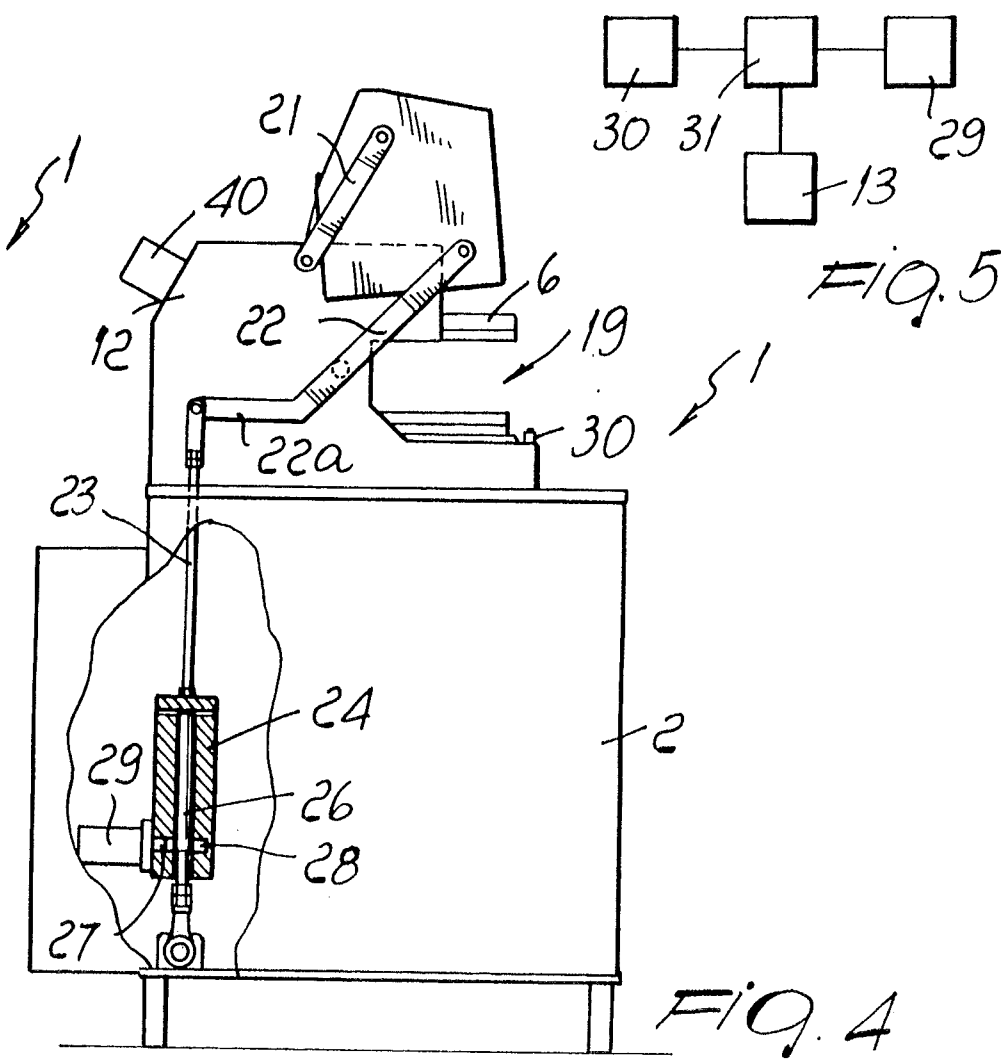
FIG. 5
FIG. 4
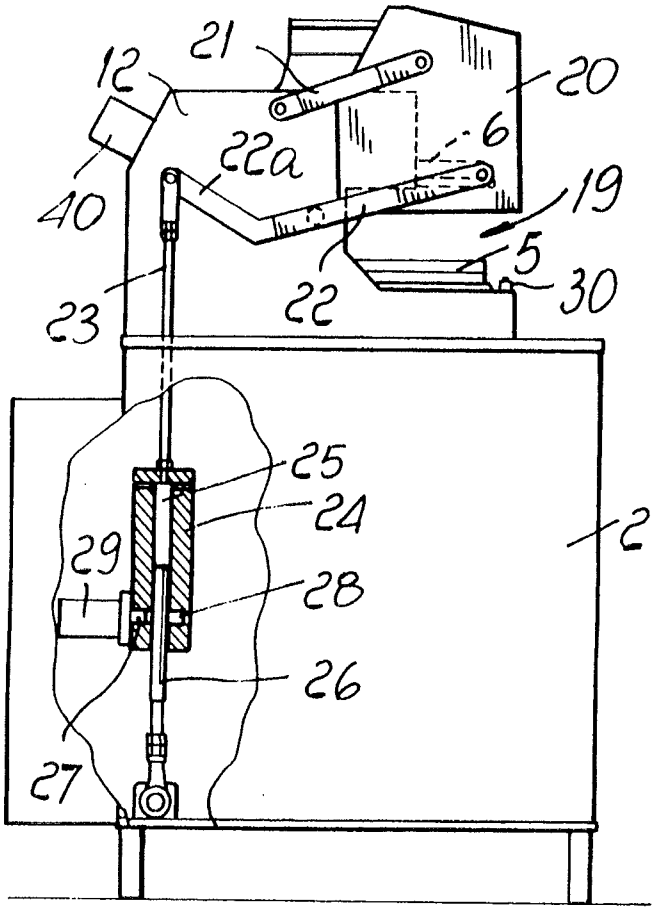
FIG. 3

MACHINE FOR THE CENTRIFUGAL MOLDING OF LOW-MELTING METALS OR SYNTHETIC MATERIALS

BACKGROUND OF THE INVENTION

The present invention relates to a machine for the centrifugal molding of low-melting metals or synthetic materials.

Machines for the centrifugal molding of low-melting metals or of synthetic materials are known; they generally comprise a main structure which supports, so that it can rotate about a substantially vertical rotation axis, a lower plate which supports a centrifugal molding die, constituted by two superimposed half-dies, and facing an upper plate along a substantially horizontal plane. One of the two plates, generally the lower one, is movable by actuation along a direction parallel to the rotation axis toward or away from the other plate, so as to ensure that the die closes during the molding of the injected molten material or allow its removal. The molding cavities are formed on the two opposite faces of the half-dies constituting the molding die, and are connected to a single central channel which passes through the upper half-die and the upper plate to receive the molten material to be molded.

A motor is arranged below the lower plate and drives, with a rotary motion about said rotation axis, the lower plate, the upper plate and the die arranged between said plates, so as to distribute the molten material, introduced in the central channel, into the molding cavities, where it hardens and reproduces the shape of said cavities.

Usually, for safety reasons, the lower plate and the upper plate are arranged inside a chamber delimited by a housing of the main structure and provided with an opening to allow access to the molding die during the unloading of the molded parts or the possible replacement of the molding die. This opening is closed by a tilting cover which is hinged to the housing of the main structure about a substantially horizontal axis.

These known types of machines for the centrifugal molding of low-melting metals or synthetic materials have some drawbacks:

Since the cover is generally hinged to two oppositely arranged side walls of the housing delimiting the chamber which accommodates the die, and since an upwardly protruding inlet of the central channel is provided on the upper wall of the housing, the opening arc of the cover is limited, making it difficult for the operator to reach the die.

SUMMARY OF THE INVENTION

An aim of the present invention is to obviate the drawback described above by providing a machine for the centrifugal molding of low-melting metals or synthetic materials in which access to the die is particularly easy.

Within the scope of this aim, an object of the invention is to provide a machine that offers adequate assurances of safety against the accidental opening of the cover during operation.

Another object of the invention is to provide a machine in which machine downtime is reduced with respect to conventional centrifugal molding machines.

With these and other aims in view, there is provided, according to the present invention, a machine for the centrifugal molding of low-melting metals or synthetic materials, comprising a main structure which supports, so that they can rotate about a substantially vertical rotation axis, a lower plate for supporting a centrifugal molding die and an upper plate, said plates being mutually superimposed, facing each other on a substantially horizontal plane and being mutually movable by actuation in a direction parallel to said rotation axis, said plates being accommodated in a chamber which is delimited by walls connected to said main structure and has, on the front side of the machine, an opening for access to said die, said opening being closed by a movable cover, wherein said cover is connected to at least one of the side walls delimiting said chamber by a pair of connecting rods, each of said connecting rods being pivoted, with its ends, respectively to said cover and to said side wall with substantially horizontal pivoting axes for the opening movement of said cover along a vertical upward component and along a horizontal component toward the rear side of the machine.

BRIEF DESCRIPTION OF THE DRAWINGS

Further characteristics and advantages of the present invention will become apparent from the following detailed description of a preferred embodiment thereof, illustrated only by way of non-limitative example in the accompanying drawings, wherein:

FIG. 3 is a lateral elevation view of the machine according to the invention, with the cover in an intermediate position;

FIG. 4 is a lateral elevation view of the machine according to the invention, with the cover in open position;

FIG. 5 is a schematic view of the connection of the components of the machine that control its operation.

DESCRIPTION OF THE PREFERRED EMBODIMENTS

Figure 2:
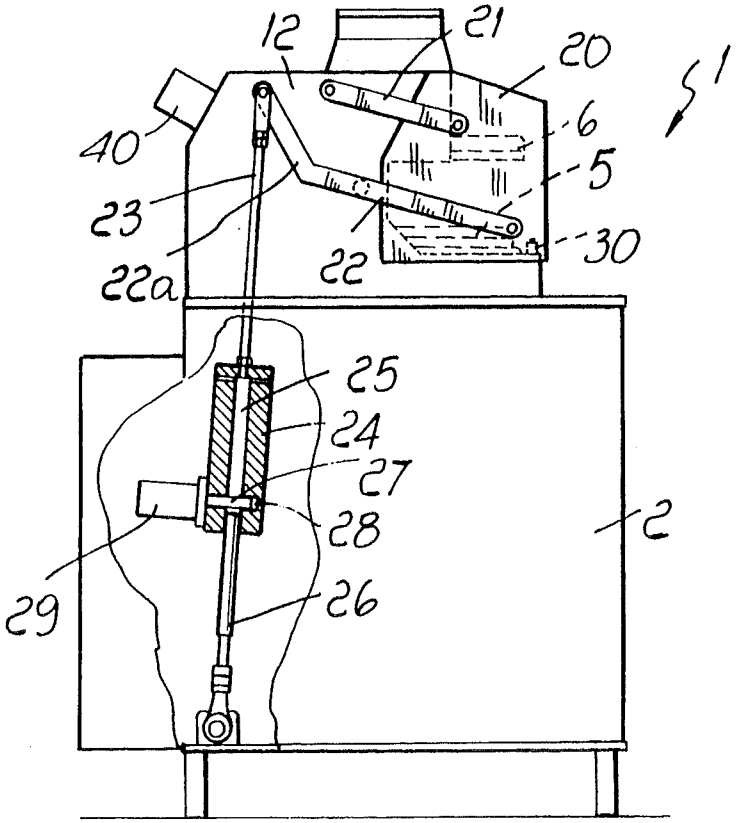
FIG. 2 is a lateral elevation view of the machine according to the invention, with the cover in closed position.
Figure 1:
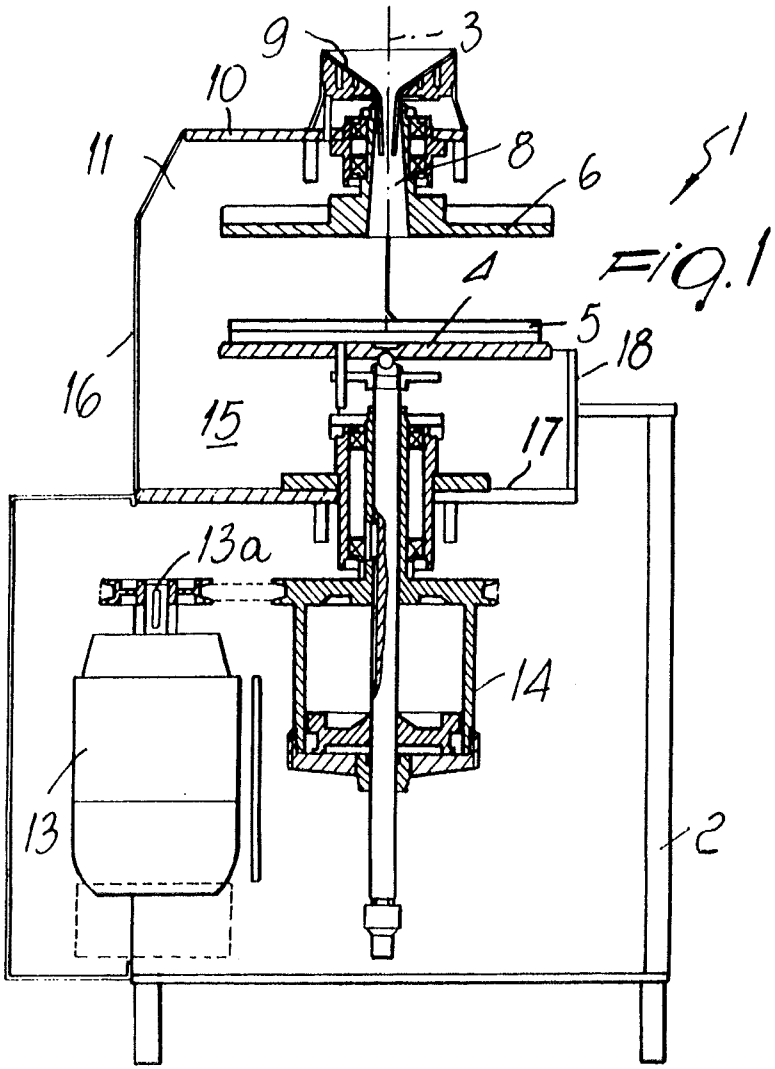
FIG. 1 is a schematic sectional view of the machine according to the invention, taken along a median vertical plane and with the cover removed.

With reference to the above figures, the machine according to the present invention, generally designated by the reference numeral 1, comprises a main structure 2 which supports, so that they can rotate about a vertical rotation axis 3, a lower plate 4, which supports a centrifugal molding die 5 constituted by two superimposed half-dies into which the molten material to be molded is introduced, and an upper plate 6.

The plate 6 is centrally crossed by a molding channel 8 connected to a channel formed in the upper half-die of the die 5 and branches into the various molding cavities formed in the two half-dies. The molding channel 8 extends upward and is connected to an inlet 9 formed proximate to the upper end of the machine.

More particularly, the lower plate 5 faces the upper plate 6 along a substantially horizontal plane, and the upper plate 6 is supported, by means of bearings, by an upper cross-member 10 which joins two lateral shoulders 11 and 12 which rise vertically and are rigidly fixed to the main structure 2.

The lower plate 4 is connected, in a per se known manner, to the output shaft 13*a* of a motor 13 arranged below the main structure 2 and supported thereby.

The lower plate 4 can furthermore move by actuation, for example by virtue of the action of a pneumatic cylinder 14, along a direction parallel to the rotation axis 3 to move toward or away from the upper plate 6 in order to ensure the closure of the die 5 or allow its removal.

The plates 4 and 6 are accommodated in a chamber 15 delimited by a rear wall 16, by side walls constituted by said shoulders 11 and 12, by the upper cross-member 10, by a base wall 17 extending parallel to the upper cross-member 10, and by a front wall 18. The chamber 15 has an opening 19 which affects the front wall 18 and partially affects the two shoulders 11 and 12.

Said opening 19 is closed by a cover 20 which can move to allow access to the die 5 arranged in the chamber 15.

According to the present invention, the cover 20 is connected to the shoulders 11 and/or 12 by means of at least one pair of connecting rods, and each of these connecting rods, respectively designated by the reference numerals 21 and 22, is pivoted to the cover 20 with one of its ends and to the related shoulder 11 or 12 with its other end.

More particularly, the cover 20 has a box-like structure which is open on its side directed toward the chamber 15 and accommodates the die 5, and the connecting rods 21 and 22 are arranged substantially parallel to each other and are spaced parallel to the axis 3.

In this manner, the cover 20 has an opening movement having an upward vertical component and a horizontal component in the direction of the rear side of the machine, thus considerably facilitating access for the operator to the die 5.

Advantageously, the connecting rod 22 has an extension **22*a* which extends beyond the point where it is pivoted to the related lateral shoulder 11 or 12 and is connected, by means of a rod 23, to a counterweight 24 which is accommodated inside the main structure of the machine and facilitates by gravity the opening movement of the cover 20**.

Furthermore, a sliding guide 25 for a rod 26 is formed inside the counterweight 24; said rod 26 is hinged, with its lower end, to the main structure 2. Conveniently, there are means for locking the counterweight 24 when the cover 20 is in a closed position. Said locking means comprise a pin 27 which can move along a seat 28 extending transversely to the extension of the sliding guide 25. The pin 27 is connected to the stem of the piston of a pneumatic cylinder 29 which is fixed laterally to the counterweight 24 and can be actuated in order to move the pin 27 so that it engages the sliding guide 25, so as to block the descent of the counterweight 24 along the rod 26 or so as to release the sliding guide 25 in order to allow the descent of the counterweight 24.

The machine according to the present invention furthermore comprises means for detecting the closure of the cover 20, said means being constituted by a microswitch 30 fixed to one of the walls that delimit the chamber 15, in such a position that it is touched by the cover 20 when it is moved into its closed position.

Advantageously, the microswitch 30, as shown schematically in FIG. 5, is connected to control element 31, for example a programmable microprocessor, which supervises the operation of the machine so that the control element 31 actuates the motor 13 as soon as the microswitch 30 indicates that the cover 20 has closed, without requiring any further starting operation on the part of the operator.

For greater safety, the pneumatic cylinder 29 can also be operatively connected to the control element 31 so that after the closure of the cover 20, detected by means of the microswitch 30, the control element 31 locks the counterweight 24 before actuating the motor 13 that rotates the die. The control element 31 can furthermore be programmed so that the pneumatic cylinder 29 is deactivated, thus releasing the counterweight 24 only after the motor 13 stops.

Conveniently, a port 40 is provided on the rear wall that delimits the chamber 15 and is connected to an aspirator to remove any fumes that may form inside said chamber 15.

In practice it has been observed that the machine according to the present invention fully achieves the intended aim, since the particular connection between the cover and the walls delimiting the chamber which contains the die makes access to the die with the cover in an open position much easier.

Another advantage is that the machine is actuated automatically simply by closing the cover, without requiring further intervention on the part of the operator and thus reducing machine downtime.

A further advantage is that the invention provides a high degree of safety against the danger of accidental openings of the cover during machine operation.

Although the basic concept of the present invention has been conceived in particular for a machine for the centrifugal molding of low-melting metals or synthetic materials, it may nonetheless be applied advantageously, as regards accessibility, machine downtimes and safety, even to vulcanizing units or furnaces for the casting of low-melting metals.

In practice, the materials employed, as well as the dimensions, may be any according to the requirements and the state of the art.

I claim:

1. Machine for the centrifugal molding of low-melting metals or synthetic materials, comprising a main structure which supports, so that they can rotate about a substantially vertical rotation axis, a lower plate for supporting a centrifugal molding die and an upper plate, said plates being mutually superimposed, facing each other on a substantially horizontal plane and being mutually movable by actuation in a direction parallel to said rotation axis, said plates being accommodated in a chamber which is delimited by side walls connected to said main structure and has, on a front side of the machine, an opening for access to said die, said opening being closed by a movable cover, wherein said cover is connected to at least one of the side walls delimiting said chamber by a pair of connecting rods, each of said connecting rods having ends which are pivoted respectively to said cover and to said at least one of the side walls with substantially horizontal pivoting axes for the opening movement of said cover along a vertical upward component and along a horizontal component toward a rear side of the machine.

2. Machine according to claim 1, wherein the connecting rods of said pair of connecting rods are arranged substantially parallel to each other.

3. Machine according to claim 1, comprising means for detecting the closure of said cover which are operatively connected to a control element supervising the operation of the machine for the actuation of the machine when the cover is closed.

4. Machine according to claim 3, wherein said detection means are constituted by a microswitch which is connected to said main structure proximate to said opening, said microswitch being arranged so as to be touched by said cover during closure.

5. Machine according to claim 1, wherein one of said connecting rods has an extension which extends beyond the point where it is pivoted to said at least one of the side walls connected to said main structure, said extension being connected to a counterweight which facilitates the opening movement of said cover.

6. Machine according to claim 5, comprising means for locking said counterweight when said cover is in a closed position.

7. Machine according to claim 6, wherein said counterweight is internally provided with a sliding guide for a guiding rod hinged to said main structure, said locking means being constituted by a pin which is associated with said counterweight and which is controllably actuatable to close said sliding guide in order to stop the sliding of said counterweight along said guiding rod.

8. Machine according to claim 6, comprising means for detecting the closure of said cover which are operatively connected to a control element supervising the operation of the machine for the actuation of the machine when the cover is closed, and wherein said locking means are operatively connected to said control element and to said means for detecting the closure of said cover.

9. Machine according to claim 1, wherein said cover is constituted by a box-like structure with an opening facing the opening of said chamber.

10. Machine for vulcanizing molds or for casting low-melting metals, comprising a box-like structure connected to a main structure of the machine and delimiting a chamber which has, on a front side thereof, an opening closed by a movable cover, wherein said cover is connected to at least one side wall delimiting said chamber by a pair of connecting rods, each of said connecting rods having ends which are pivoted respectively to said cover and to said at least one side wall with substantially horizontal pivoting axes for the opening movement of said cover along an upward vertical component and along a horizontal component toward a rear side of the machine.

11. Machine according to claim 10, wherein the connecting rods of said pair of connecting rods are arranged substantially parallel to each other.

12. Machine according to claim 10, comprising means for detecting the closure of said cover which are operatively connected to a control element supervising the operation of the machine for the actuation of the machine when the cover is closed.

13. Machine according to claim 12, wherein said detection means are constituted by a microswitch which is connected to said main structure proximate to said opening, said microswitch being arranged so as to be touched by said cover during closure.

14. Machine according to claim 10, wherein one of said connecting rods has an extension which extends beyond the point where it is pivoted to said at least one of the side walls connected to said main structure, said extension being connected to a counterweight which facilitates the opening movement of said cover.

15. Machine according to claim 14, comprising means for locking said counterweight when said cover is in a closed position.

16. Machine according to claim 15, wherein said counterweight is internally provided with a sliding guide for a guiding rod hinged to said main structure, said locking means being constituted by a pin which is associated with said counterweight and which is controllably actuatable to close said sliding guide in order to stop the sliding of said counterweight along said guiding rod.

17. Machine according to claim 15, comprising means for detecting the closure of said cover which are operatively connected to a control element supervising the operation of the machine for the actuation of the machine when the cover is closed, and wherein said locking means are operatively connected to said control element and to said means for detecting the closure of said cover.

18. Machine according to claim 10, wherein said cover is constituted by a box-like structure with an opening facing the opening of said chamber.

* * * * *